United States Patent [19]

Curt

[11] Patent Number: 4,685,838

[45] Date of Patent: Aug. 11, 1987

[54] RETAINING WALL

[76] Inventor: Valerian Curt, 45 De Bercy, Candiac, Quebec, Canada, J5R 4B8

[21] Appl. No.: 622,558

[22] Filed: Jun. 20, 1984

[51] Int. Cl.[4] ..... E02D 29/02

[52] U.S. Cl. ..... 405/284; 405/258

[58] Field of Search ..... 405/31, 107, 110, 114, 405/116, 117, 125, 229, 258, 262, 272, 284, 285

[56] References Cited

U.S. PATENT DOCUMENTS

| | | | |
|---|---|---|---|
| 2,453,609 | 11/1948 | Whitehouse . | |
| 2,769,277 | 11/1956 | Keelor | 405/284 X |
| 2,911,794 | 11/1959 | Pearson . | |
| 3,316,721 | 5/1967 | Heilig . | |
| 3,570,253 | 3/1971 | Vidal | 405/284 |
| 4,211,504 | 7/1980 | Sivachenko . | |
| 4,220,423 | 9/1980 | Sivachenko | 405/284 |
| 4,341,491 | 7/1982 | Neumann . | |
| 4,521,138 | 6/1985 | Steiner | 405/284 |

FOREIGN PATENT DOCUMENTS

| | | |
|---|---|---|
| 2757465 | 6/1979 | Fed. Rep. of Germany . |
| 223857 | 1/1975 | France . |

*Primary Examiner*—David H. Corbin

*Attorney, Agent, or Firm*—Oblon, Fisher, Spivak, McClelland & Maier

[57] ABSTRACT

This invention relates to a retaining wall structure of generally U-shaped cross-section, in which the lateral pressure created by the retained mass acts to retain the wall in position.

13 Claims, 13 Drawing Figures

RETAINING WALL

This invention relates to a retaining wall structure, and in particular, to a retaining wall structure which is retained in position by the lateral pressure of the retained mass.

A number of different types of retaining walls are presently in use. Such retaining walls generally utilize one of two principles for support. The first type is supported externally of the retained mass by ribs or similar means extending on the outer face of the retaining wall. Another type utilizes the weight of the retained mass to contain the retained mass. In this second type of retaining wall, the face and base of the retaining wall may be maintained in perpendicular relation by tension rods extending through the retained mass, as in U.S. Pat. No. 3,316,721, or by constructing the face and base of the retaining wall as a unitary member, as is the case with many concrete retaining walls. There are drawbacks with both of the foregoing types of retaining walls. If supports are required on the exterior of the wall, those supports utilize space that may serve other purposes and also remove any aesthetic quality from the retaining wall. The second type of retaining wall, which is internally supported by the retained mass, involves either detailed construction techniques, as in U.S. Pat. No. 3,316,721, or else a large quantity of an expensive construction material such as concrete to form the unitary face and base construction.

The subject invention is a retaining wall construction that utilizes lateral pressure in the retained mass to hold the retaining wall immobile. More particularly, straight sections of the retaining wall of the subject invention are held vertically in place within the retained mass by lateral pressure exerted by the retained mass, arcuate sections defining the face of the retaining wall are connected to the straight sections, and those arcuate sections act to contain a further portion of the retained mass. In effect, lateral pressure exerted by the retained mass anchors a wall retaining that mass.

The retaining wall structure of the subject invention is not only cheaper to construct than conventional walls, it is also more quickly installed using less manpower.

In one form, the invention is an embankment retaining wall structure having a generally U-shaped cross-section and comprising an arcuate section, having a generally semi-cylindrical shape, and a pair of rectangular planar sections, each rectangular planar section being adapted to connect to a respective one of the straight edges of the arcuate section. The arcuate section is adapted to define the face of the wall and the rectangular planar sections are adapted to extend into the embankment, lateral pressure of the retained embankment acting on the planar sections to prevent their movement, the arcuate sections thereby also being held immobile. The rectangular planar section may be integrally connected to the arcuate section or may be connected to the arcuate section by fastener means. The arcuate and rectangular planar sections may be corrugated, the ridges of the corrugations extending generally horizontally.

In a further form, the invention is an embankment retaining wall structure which comprises a plurality of rectangular planar sections adapted to extend vertically in an embankment in generally parallel spaced relation to each other and generally perpendicular to the embankment face, and a plurality of arcuate sections, each having a generally semi-cylindrical shape and each being adapted to have its straight edges connected to the outward edges of a respective adjacent pair of the rectangular planar sections. Embankment fill within the retaining wall structure is adapted to maintain the rectangular planar sections immobile by exertion of lateral pressure thereon, and the connected arcuate sections are thus also held immobile to define the face of the retaining wall structure.

A yet further form of the invention is an embankment retaining wall structure comprising a pluralitv of members of similar, generally U-shaped, transverse cross-section and similar length, each member having each of its rectangular planar sections extending generally vertically in planar abutment with a rectangular planar section of another member, each member also having its arcuate section extending generally vertically. Fill placed within the members exerts a lateral pressure on the rectangular planar sections to anchor those sections in the fill, and the arcuate sections each provide containment of the fill and together define the face of the wall structure.

A still further form of the invention relates to a method of constructing an embankment retaining wall utilizing one of the foregoing wall structures, the method generally comprising the steos of positioning the wall structure such that its arcuate section or sections define the retaining wall face and the rectangular planar sections extend generally perpendicular to that embankment face, and then placing embankment fill within the cavity or cavities defined by the arcuate rectangular planar sections such that the fill exerts a lateral pressure on the rectangular planar sections to hold those sections immobile, the connected arcuate section or sections acting to contain the remainder of the fill.

In the preferable form of the invention, the in situ separation distance between adjacent pairs of rectangular planar sections is approximately one-half of the in situ height of the arcuate and rectangular planar sections.

The retaining members of the subject invention must be fabricated at a factory from a material which exhibits a high resistance to tensile stress. The material must also exhibit characteristics which allow it to meet architectural and environmental conditions, and be compatible with the end use of the structure and the quality of the backfill.

The choice of the specific geometry and thickness of the retaining members with respect to the height of the structure are determined to produce the structure at minimal cost, consistent with internal stability calculations. Good resistance to tension force by the retaining member and good capacity to develop shear friction by the fill are essential for internal stability of the structure. The geometry as well as the thickness of each retaining member can be varied along its height.

The durability and yield stress of a retaining member are important criteria in choosing materials. Its durability depends on its resistance to corrosion when exposed to the fill. The rate of corrosion of a retaining member depends upon the material utilized in its fabrication and on the type of fill, i.e. the pH of the interstitial water and the resistivity of the fill. All non-clay granular materials suitable for road construction can be considered compatible with all the materials from which retaining members are fabricated. In certain cases, the retaining member can be coated with paints based on bitumen, epoxy, etc., to prevent corrosion.

The main fabrication materials for retaining members are foreseen to be steels such as Type ASTM-A446-69 Grade A, galvanized steel, stainless steel, cor-ten steel, or aluminum alloys or plastics. A single quality of material can be used, or alternately, a combination of materials can be used if the constituent materials are electrochemically compatible.

With respect to transportation and installation of the retaining members, the members can either be of unitary construction or can be fabricated in pieces and assembled at the construction site. If need be, they can be made water-tight. The retaining members may be the complete retaining structure or there may additionally be present horizontal reinforcing members of wire mesh or textile membrane, each reinforcing member being adapted to be positioned inside of a respective retaining member. Anchor plates may also be integrally formed on one edge of each rectangular planar section of the retaining members, the anchor plates being adapted to extend vertically in the fill to present greater resistance to pull out of the retaining members. Such anchor plates may be made of metal or precast concrete. Anchor plates are especially useful for rocky areas where excavation is difficult and only limited room is available for placement of the retaining members. If need be, the retaining members could be anchored to adjacent rocky slopes.

Once completed, a retaining wall formed from the retaining members of the subject invention can be faced with precast concrete elements, bricks, or shotcrete. Some time must be allowed for settling of the wall, the corrugations in the retaining members providing for uniform settling and thus avoiding buckling. The foundation of the wall will generally be horizontal but can be inclined or even be below the water level if the wall is adapted to stand in water.

Once the retaining members have been positioned, fill is placed into the members such that the planar rectangular sections are covered first with subsequent fill being placed between that initial fill and the arcuate section. The fill is deposited in layers, and each layer may be compacted prior to placement of the next layer. Compaction is not essential, but does serve to reduce the amount of subsequent settling of the fill.

Retaining walls utilizing the structure of the subject invention could be permanent structures or could be temporary, for instance on large construction sites or for mine operations. The retaining members can be reutilized after a temporary use. Roadways, bridge approaches, residential terraces, and reservoir walls are other uses for the retaining wall of the subject invention; reservoir walls and similar uses would require a watertight structure. Flood control dikes, which must be constructed quickly, are an especially important application of the subject invention. On site fill could be used with low dikes. Still other applications of the subject invention include dams, with or without spillways, pier walls, and various industrial structures.

The subject invention will now be more fully described by means of the accompanying drawings, in which.

Figure 1:
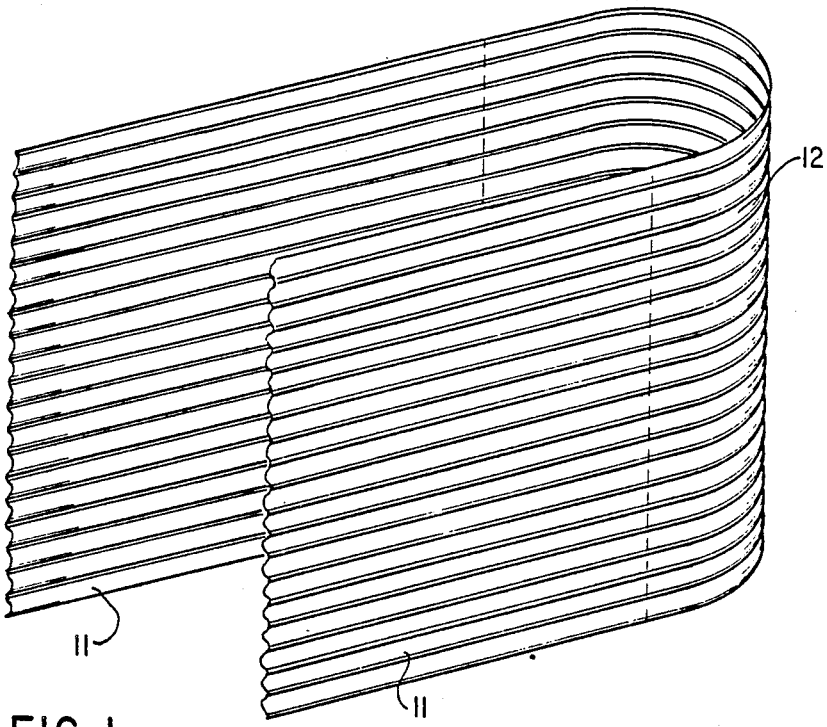
FIG. 1 is a perspective view of a single member of one form of the retaining wall structure of the subject invention.
Figure 2:
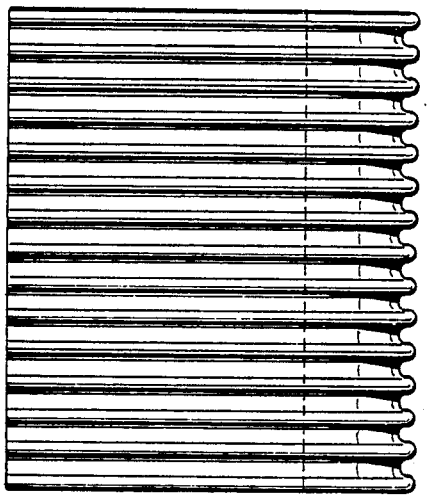
FIG. 2 is a side view of the member of FIG. 1.
Figure 3:
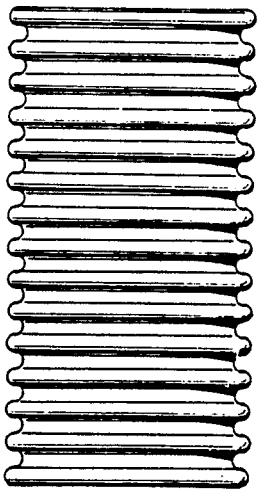
FIG. 3 is a back view of the member of FIG. 1.

Referring now to the drawings, FIG. 1 is a perspective view of a retaining member utilized in one form of the subject invention. The member has a pair of rectangular planar surfaces 11 and an arcuate surface 12 integrally connected therewith. The arcuate surface illustrated is semi-circular, but it could also be eliptical, funiculaire or of another shape. The member is formed from corrugated galvanized steel sheet, for instance,-sheet of Type ASTM-A446-69 Grade A steel or equivalent, which is protected against corrosion by galvanization or other method. It has dimensions that will subsequently be more fully discussed. The steel sheet is shaped such that each of the ridges in arcuate surface 12 extend through each planar surface 11. FIG. 2 is a side view of the member of FIG. 1, and FIG. 3 is an end view of the member of FIG. 1. The member illustrated is formed from steel, but it could also be formed from aluminum, plastic, or other non-corrosive material.

Figure 4:
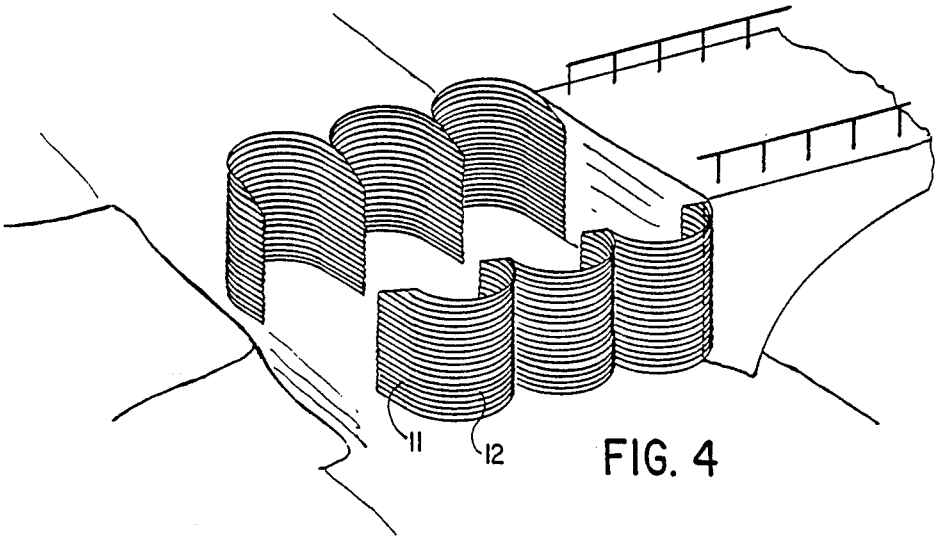
FIG. 4 illustrates a series of members, each similar to the member of FIG. 1, together forming a pair of retaining wall structures at construction site.
Figure 5:
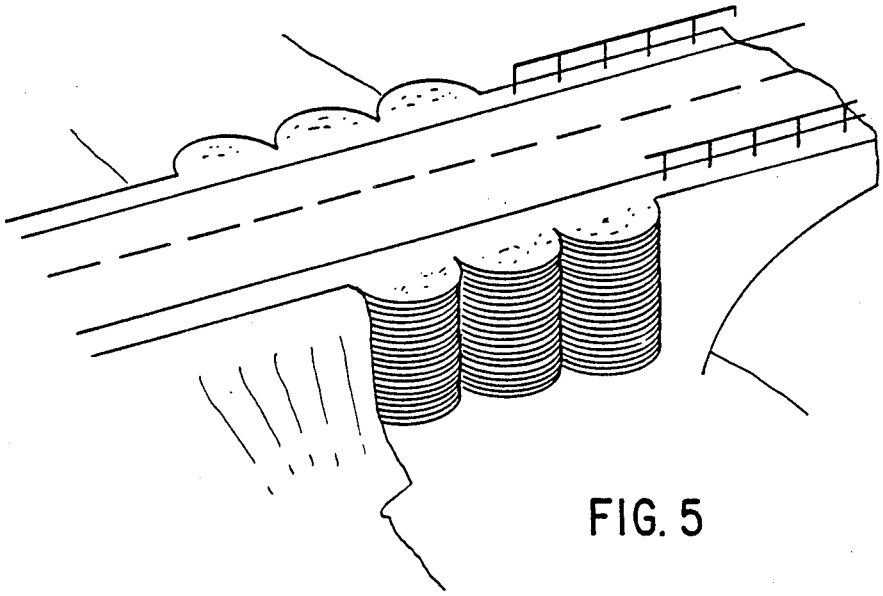
FIG. 5 illustrates the retaining wall structure of FIG. 4 after fill has been placed within the members of those structures.

FIG. 4 illustrates a series of the retaining wall members of FIG. 1 positioned such that each rectangular planar section of each member is in planar abutment with a rectangular planar section of an adjoining member. In FIG. 4, the members are positioned at one end of a newly-constructed bridge prior to completion of the ramps leading to the bridge. FIG. 5 illustrates the retaining wall created by the members of FIG. 4 after fill has been placed into the cavity defined by the end of the bridge and the double row of retaining members to complete that ramp leading to the bridge.

The foregoing has been a brief introduction to the invention to assist in its understanding.

Figure 6:
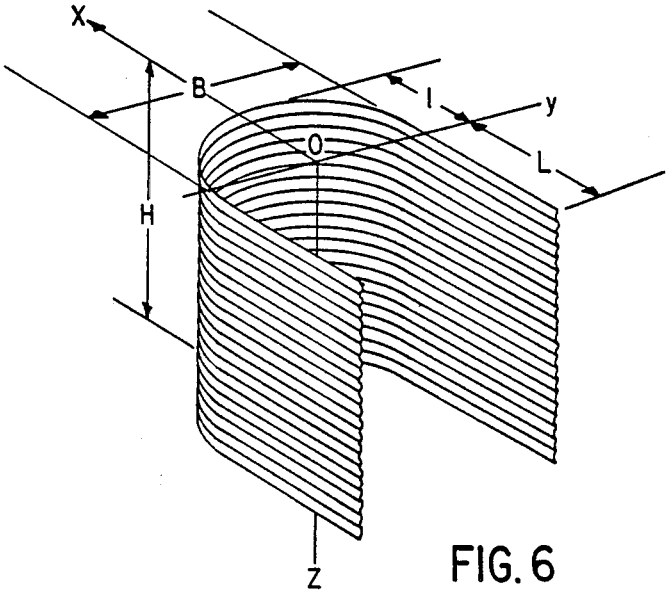
FIG. 6 is a perspective view of a member utilized in one form of the subject invention, relevant dimensions being identified on the member.
Figure 7:
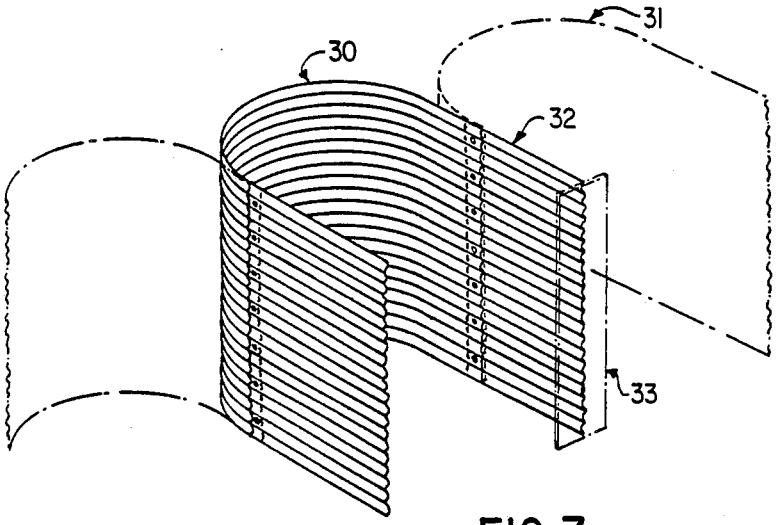
FIG. 7 is a perspective view of a plurality of arcuate and rectangular planar sections utilized in a second form of the invention.

The retaining wall structure of the subject invention may either utilize discrete members as in the previous example or may utilize a series of rectangular planar sections and a series of arcuate sections adapted to connect therewith. FIGS. 6 and 7 illustrate these alternate embodiments of the invention. The invention utilizes the traction created by the retained mass to anchor the rectangular planar sections which in turn secure the connected arcuate sections which retain a further portion of the retained mass. In FIG. 6, the rectangular planar sections of each member of the retaining wall structure are integrally connected to the arcuate section of that member. In FIG. 7, the arcuate and rectangular planar sections that comprise the other embodiment of the subject invention are connected together by means of fasteners such as bolts. As mentioned, the subject invention may utilize corrugated galvanized steel sheets, which are well-known in the construction industry, or might use sheets of aluminum or plastic or other non-corrosive material. Corrugated galvanized steel sheets are readily-available at low cost and have another benefit very important to the subject invention, namely, the ability of corrugated material to be compressed along its surface in a direction normal to the corrugation ridges. The importance of this feature is that fill behind a retaining wall settles over a period of time and, due to the friction between the fill and the face of the retaining wall, the retaining wall will be pulled downwardly; without the corrugations, uneven buckling of the face of the retaining wall would result from such downward movement.

With reference to FIG. 6, the retaining member illustrated has a pair of planar rectangular sections of length L and height H integrally connected to a semi-cylindrical section of diameter B and height H. In the embodiment illustrated in FIG. 6, 'l' is equal to 0.5B; 'l' would however bear a different relationship to B if the arcuate section were elliptical, funiculaire, or of another shape.

The following analysis will relate the length L, height H, and diameter B of retaining members required to form a retaining wall given the specific weight ($\gamma$) of the retained fill and the lateral earth pressure coefficient (k) of the retained fill. The allowable stress of the steel of the retaining members will be characterized as $\sigma_a$.

With reference to FIG. 6, the tension force acting on the outward end of each rectangular side section along the plane x =o is equal to one-half of the force exerted by the fill on that plane:

$$\sigma_a \cdot \mu \cdot t \cdot = \tfrac{1}{2} k \gamma BH \tag{1}$$

where 't' is the thickness of the sheet steel and '$\mu$' is a developed width factor that accounts for the extra material present because of the corrugations. Therefore, $$t = \frac{k\gamma BH}{2\sigma_a \mu} \tag{2}$$

where 't' is directly proportional to the length B and the height H of the retaining member.

A typical value for the allowable stress $\sigma_a$ of the retaining member is $1.50 \times 10^8$ Pascals, assuming use of a steel such as Type ASTM-A446-69 Grade A. A typical value for $\mu$ is 1.25, and a typical value for the fill density is $\gamma = 1.8$ T./m.$^3$. For such values of $\sigma_a$, $\mu$, and $\gamma$, $$t = 0.48 \times 10^{-7}\ \text{kBH (mm.)} \tag{3}$$

where 'k' is the lateral earth pressure co-efficient, and B and H are width and height dimensions in millimetres of the retaining member as illustrated in FIG. 6.

Figure 8:
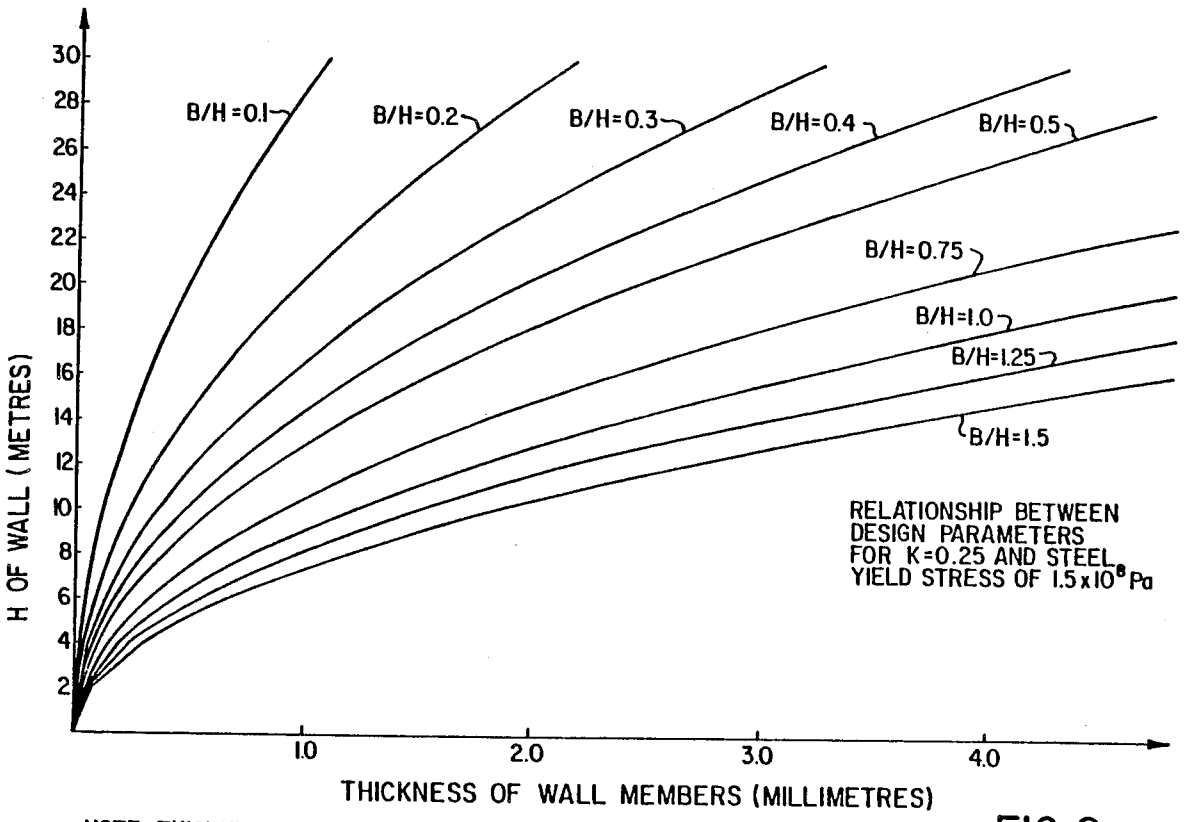
FIGS. 8 to 10 are graphs illustrating the relationship between design parameters for retaining walls having B/H values of 0.10, 0.20, 0.30, 1.40, 0.50, 0.75, 1.00, 1.25 and 1.50 respectively, B and H being dimensions of the retaining wall identified in FIG. 6.
Figure 9:
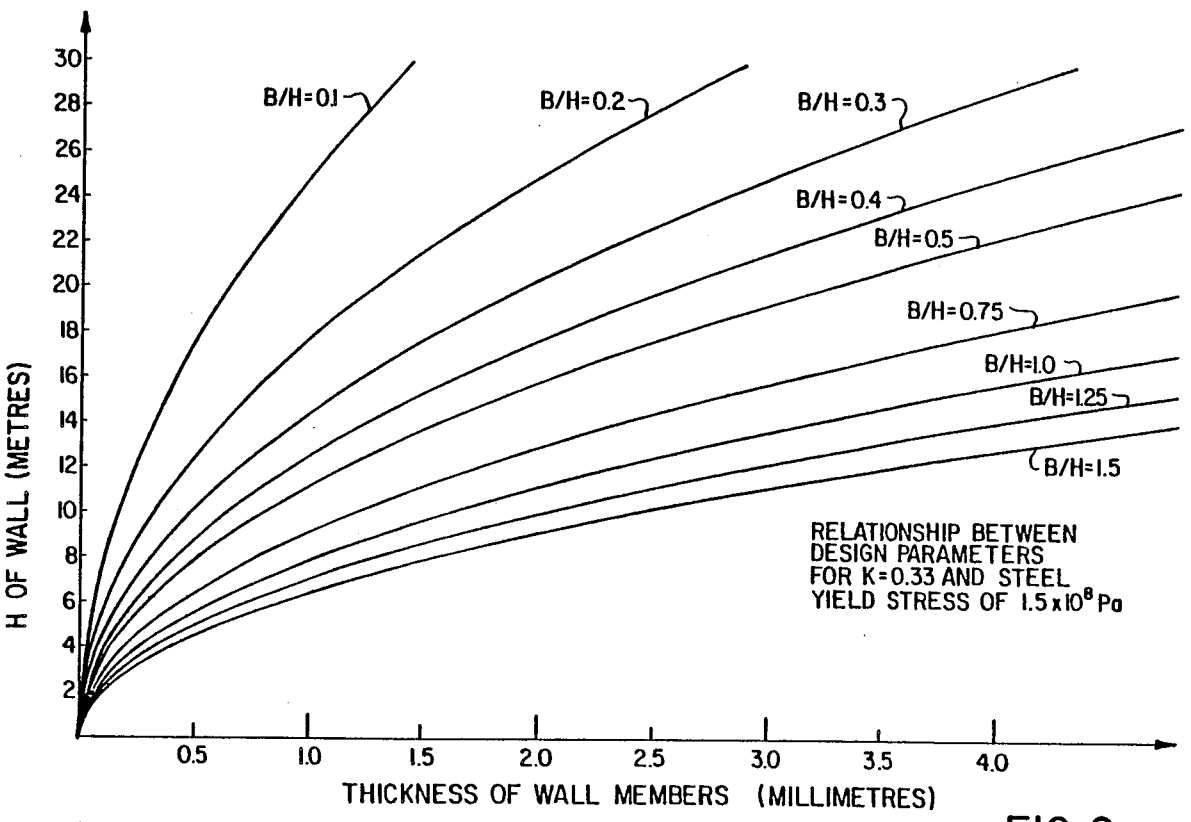
Figure 10:
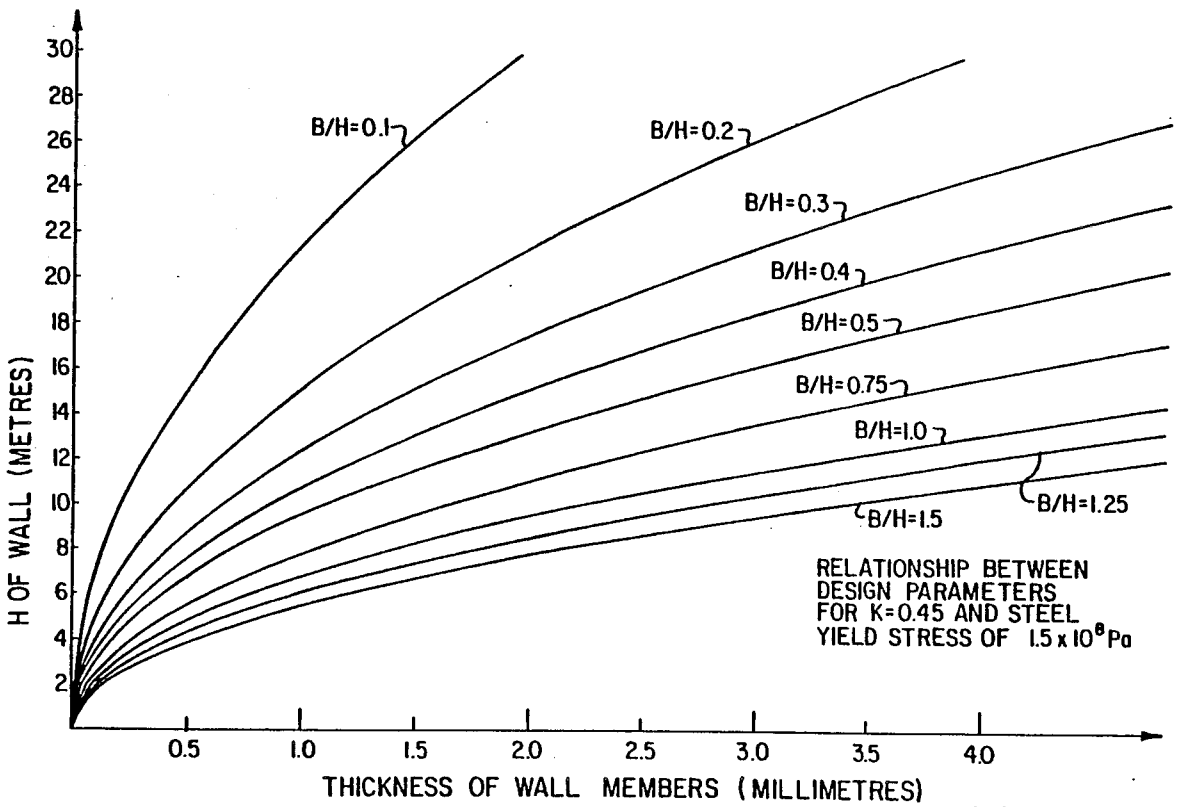

FIGS. 8 to 10 illustrate the relationship between B, H, k, and t for nine values of B/H, namely, 0.10, 0.20, 0.30, 0.40, 0.50, 0.75, 1.00, 1.25 and 1.50, and for three values of k, namely, 0.25, 0.33, and 0.45.

Figure 11:
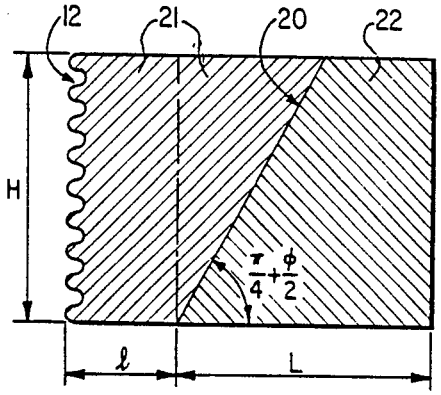
FIG. 11 illustrates the slip plane in a retaining member loaded with fill only, as predicted by Coulombe's Theory.
Figure 12:
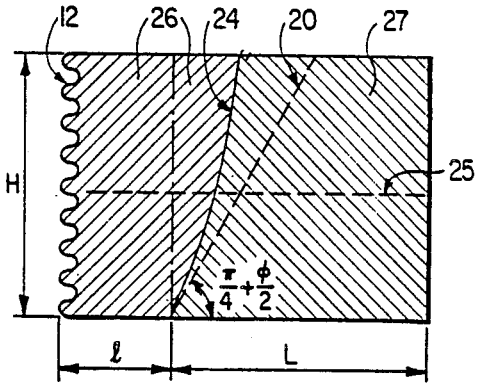
FIG. 12 illustrates the slip plane in a retaining member loaded with fill and also having horizontal synthetic textile fold or wire meshes.
Figure 13:
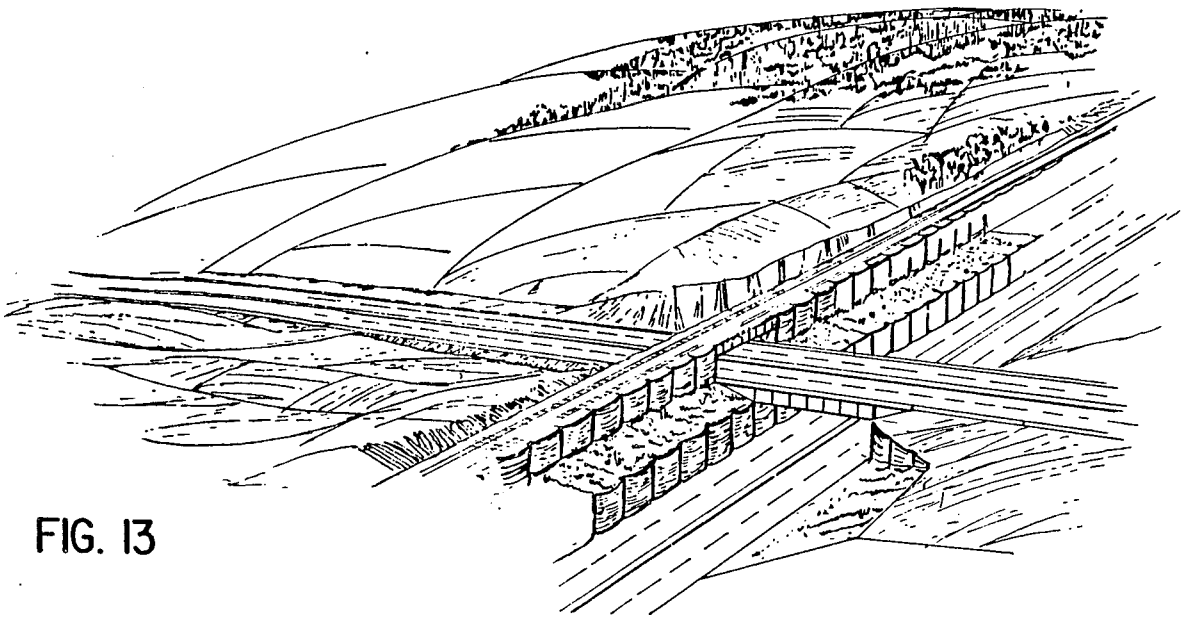
FIG. 13 illustrates one conception of the multiple utility of the subject invention.

L (required length of the planar rectangular sections) can be determined theoretically from the requirement that the pair of planar rectangular sections will not be dislodged, i.e. moved forwardly, when fill is placed into the retaining member. FIG. 11 illustrates a cross-sectional view through a retaining member loaded with fill and indicates the slip plane 20 dividing the active zone 21 and passive zone 22 of the retained fill. The passive zone is that part of the retained fill which is stable and in which the development and transmission of resistive friction or shear forces occur. The active zone is that portion of the fill that, if not restrained by the retaining member, would slide on the slide plane. The slip plane forms an angle ($\pi/4+\phi/2$) to the horizontal. The angle $\pi$ is taken as equivalent to the fill's angle of internal friction, and is thus also linked to the k value of the fill material. FIG. 12 illustrates the slip plane 24 in a retaining member loaded with fill and also having horizontal synthetic textile fold or wire meshes 25. The active zone 26 is decreased and the passive zone 27 increased over the situation illustrated in FIG. 11.

By theoretical considerations, the retaining member will not be pulled out if (assuming only fill is in the retaining member):

$$L_p = B/2 \cdot n_p \cdot \cot \phi \tag{4}$$

where $\eta_p$ is the factor of safety against pull out, and if, $$L_p \geqq \text{H} \cot (\pi/4 + \phi/2) \tag{5}$$

From (4) and (5), the minimum possible B/H value to prevent pullout of the retaining member is:

$$\frac{B}{H} = \frac{2}{\eta_p} \frac{\tan \phi}{\tan\left(\frac{\pi}{4} + \frac{\phi}{2}\right)} \tag{6}$$

and the minimum value of thickness which corresponds to that B/H value is:

$$t = \frac{k \cdot \gamma \cdot \tan \phi}{\mu \cdot \eta_p \cdot \sigma_a \cdot \tan\left(\frac{\pi}{4} + \frac{\phi}{2}\right)} H^2 \tag{7}$$

which relates the thickness of the retaining wall material to the height of the wall, the amount of corrugation in the wall, and the properties of the retaining wall and the retained fill. It has been found that the B/H value should be greater than 0.5. The retaining wall members should be formed of steel approximately 2 millimeters thicker than that calculated so as to allow for corrosion.

Another equation can be derived to relate the length L of the planar rectangular sections to overturning of the entire structure. The overturning lengths, $L_o$, in terms of H is:

$$H \cdot \sqrt{\frac{1}{3} k\, \eta_o} \tag{8}$$

where $\eta_o$ is the factor of safety against overturning. The length L must be greater than $L_o$.

It is also possible for the entire retaining member and its contents to slide. The sliding length, $L_s$, in terms of H is:

$$\tfrac{1}{2} \cdot \eta_s \cdot \text{k} \cdot \text{H} \cdot \cot \phi \tag{9}$$

where $\eta_s$ is the factor of safety against sliding. The length L must be greater than $L_s$.

From equations (4), (8), and (9), the length L of the planar rectangular sections of the retaining member must be greater than each of:

$$B/2\cdot\eta_p\cdot\cot\phi \quad (4)$$

$$H\cdot\sqrt{\frac{1}{3}\cdot k\cdot\eta}\ . \quad (8)$$

$$\tfrac{1}{2}\cdot\eta_s\cdot k\cdot H\cdot\cot\phi \quad (9)$$

Each of these equations contains one or more of the variables B, H, $\eta$, k and cot $\phi$ (k and $\phi$ are directly related).

If $\eta_p=\eta_o=\eta_s=1.5$, then the minimum length L of each of the planar rectangular sections of the retaining wall can be determined in terms of B and H for each k value, i.e.

TABLE 1

| k | $L_p$ | $L_o$ | $L_s$ |
|---|---|---|---|
| 0.25 | B | 0.354 H | 0.249 H |
| ($\phi$ = 36.87°) | 0.5 H | | |
| 0.33 | 1.30 B | 0.406 H | 0.429 H |
| ($\phi$ = 30°) | 0.58 H | | |
| 0.45 | 1.823 B | 0.474 H | 0.823 H |
| ($\phi$ = 22.29°) | 0.671 H | | |

The total length of each corrugated retaining member is:

$$(2L+\pi B/2) \quad (10)$$

and the total area of each corrugated retaining member is:

$$H\cdot(2L+\pi B/2) \quad (11)$$

Sample Calculation

The invention will next be described in terms of a sample calculation having reference to the bridge approaches illustrated in FIGS. 4 and 5. The embodiments of the invention in FIGS. 4 and 5 is only one simplistic form that the invention may take, but is given for simplicity of understanding. The following conditions are assumed applicable to the fill material:

$$k=0.33$$

$$\gamma=1.8\ \text{T./m}^3$$

The following conditions are assumed applicable to the corrugated steel retaining members:

$$\mu=1.25$$

$$\sigma_a=1.5\times10^8\ \text{Pascals}$$

From equation ( 3), $$t = 0.48\times10^{-7}\times0.33\times BH\ (\text{mm.}) \quad (12)$$

$$= 1.58\times10^{-8}\ BH\ (\text{mm.})$$

where B and H are width and height dimensions in millimeters, respectively.

With reference to FIG. 4, assume that the bridge specifications require that the bridge ramps be 6 meters high. So H=6 meters.

L must be greater than $L_p$ (length with safety factor to prevent pull-out), since Table 1 indicates that for $k=0.33$, $L_p>L_s>L_o$.

Since $$L_p=H\cdot\cot(\pi/4+\phi/2), \quad (5)$$

when H=6 meters and $\phi=30°$, $$L_p=6m.\times\cot\pi/3=3.5\ \text{meters.}$$

From Equation (6), $$\frac{B}{H}=\frac{2}{\eta_p}\ \frac{\tan\phi}{\tan\left(\frac{\pi}{4}+\frac{\phi}{2}\right)}.$$

When $\eta_p=1.5$ and $\phi=30°$, the minimum B/H value is $$\frac{B}{H}=\frac{2}{1.5}\times\frac{0.576}{1.731}=0.444$$

Since B/H should be at least 0.5, as a minimum B should be (0.5)(6 meters)=3 meters.

Then, from Equation (12), $$t = 1.58\times10^{-8}\times3000\times6000\ (\text{mm})$$

$$= 0.29\ \text{mm.}$$

Therefore, the retaining wall members utilized would have a minimum thickness, apart from corrosion considerations, of 0.29 mm., a height of 6.0 meters, and a width between its planar longitudinal sections of 3.0 meters. The calculated design values are represented by the position 'X' on FIG. 9. Sheets of corrugated steel 6 meters wide by 11.7 meters (2L $+\pi$B/2) long would be utilized.

Note in FIG. 4 that the upper corners of each of the planar surfaces 11 are cut diagonally. The reason for removal of the upper corners is to prevent those corners from interfering with the roadbed. It should be clear that the deletion of those corners has no effect on the earlier calculations.

Equations (4) and (5) indicate, as might be expected, that the rectangular planar sections must extend further into the fill as the separation distance between rectangular planar sections is increased or as the height of the retaining member is increased or as the friction co-efficient between the fill and the rectangular planar section is decreased. That friction co-efficient, usually designated $K_a$, is in turn a function of the fill and is available for various fill compositions from standard civil engineering references. Certain materials, such as organic material, top soil, fine sands and clay and earth mixtures are not suitable for use as fill. Generally, all chemically-stable materials presently in use for road construction fill could be utilized in the subject invention. Laboratory tests of the fill may be necessary if the structure is of special importance. Without exception, the following granulometric grading is satisfactory. No particles greater than 300 mm.; less than 25 weight-percent of the particles greater than 150 mm.; and less than 15 weight-percent passing the No. 200 sieve.

Although the foregoing comments have had reference to retaining members having integrally-connected arcuate and planar sections as in FIG. 6, a similar analysis could be undertaken of the retaining wall construction of FIG. 7. In FIG. 7, the adjacent pair of arcuate sections 30 and 31 are connected by fasteners to the rectangular planar section 32. It should be clear that rectangular planar section 32 will be formed from material approximately twice as thick as that of the arcuate sections 30 and 31. Both embodiments of the invention may utilize an anchor plate (shown as 33 in outline in FIG. 7) of metal or precast concrete to increase the traction between the retaining member and the retained material.

In some cases it may be advantageous not to use the same fill material throughout the structure. Materials which exhibit good friction properties are placed in the area of direct contact with the retaining members. In other areas, poorer quality fill may be used.

I claim:

1. An embankment retaining wall structure comprising:

(a) a plurality of generally U-shaped members, each one of said plurality of generally U-shaped members comprising an arcuate section having a vertical axis and two vertical ends;

(b) a plurality of vertical planar sections, each one of said plurality of vertical planar sections having a vertical end connected to a corresponding one of said two vertical ends of a corresponding one of said plurality of generally U-shaped members;

(c) said plurality of generally U-shaped members being contiguous to each other defining the face of the wall structure; and (d) said plurality of vertical planar sections extending into the embankment and being sized, shaped, and positioned so that the lateral frictional forces of the retained embankment acting on both sides of said plurality of vertical planar sections exceeds the force of the embankment acting on said plurality of generally U-shaped members, thereby immobilizing the wall structure and retaining the embankment.

2. An embankment retaining wall structure as defined in claim 1, wherein the planar sections are rectangular and extend generally parallel to each other.

3. An embankment retaining wall structure as defined in claim 1, wherein the arcuate sections of each U-shaped member has its vertical ends contiguous with adjacent vertical ends of adjacent U-shaped members, and a single planar section is connected to each pair of contiguous vertical ends of adjacent pairs of arcuate sections.

4. An embankment retaining wall structure as defined in claim 1, wherein a single planar section extends from each vertical end of each arcuate member, such that contiguous pairs of vertical sections extends into the embankment and the lateral frictional forces of the retained embankment act on opposite sides of a contiguous pair of planar sections.

5. An embankment retaining wall structure as in claim 1, wherein the planar sections are rectangular and are connected to the vertical ends of said arcuate section by fastener means.

6. An embankment retaining wall structure as in claim 1, wherein the planar sections are integrally connected to the arcuate section.

7. An embankment retaining wall structure as in claim 1, wherein the arucate and planar sections are corrugated, the ridges of the corrugations extending generally horizontally.

8. An embankment retaining wall structure as in claim 1, wherein the in situ distance between adjacent planar sections of a pair is approximately one-half of the in situ height of the arcuate and planar sections.

9. An embankment retaining wall structure as in claim 1 and further comprising anchor plates, each anchor plate being connected to a respective one of the planar sections along that edge of the planar section opposite to that connected to the arcuate section, each anchor plate extending generally normal to the planar section and generally parallel to the face of the wall, the anchor plates assisting in preventing movement of the planar sections.

10. A method of constructing an embankment retaining wall comprising the steps of:

(a) aligning in generally parallel spaced relationship a plurality of planar sections, the sections being placed generally vertical and perpendicular to the embankment face;

(b) connecting to each vertical end of each adjacent pair of planar sections one of a straight end of an arcuate section, the arcuate sections being contiguous to each other and defining the face of the wall structure;

(c) determining the size and shaped of the planar section as a function of the fill material being used such that the lateral frictional forces acting on the planar sections is sufficient to retain the resulting structure;

(d) placing fill into each of the cavities defined by each adjacent pair of rectangular planar sections and the arcuate section connected therebetween;

whereby the fill exerts lateral frictional forces on the planar sections to anchor those sections in the fill, the arcuate sections being thereby retained immobile and providing containment of the fill.

11. A method as defined in claim 10, wherein the planar sections are rectangular.

12. A method of constructing an embankment retaining wall as in claim 10, wherein the arcuate and planar sections are corrugated, the ridges of the corrugations extending generally horizontally.

13. A method of constructing an embankment retaining wall as in claim 10, wherein the distance between adjacent planar sections of a pair is approximately one-half of the height of the arcuate and planar sections.

* * * * *